US010224639B2

(12) United States Patent
Chainon et al.

(10) Patent No.: US 10,224,639 B2
(45) Date of Patent: Mar. 5, 2019

(54) MULTI-BAND ANTENNA

(71) Applicant: Nokia Shanghai Bell Co., Ltd., Shanghai (CN)

(72) Inventors: Sebastien Chainon, Lannion (FR); Jerome Plet, Lannion (FR); Aurelien Hilary, Lannion (FR); Gilles Coquille, Lannion (FR); Jinju Wang, Shanghai (CN); Thomas Julien, Lannion (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 15/108,941

(22) PCT Filed: Dec. 8, 2014

(86) PCT No.: PCT/CN2014/093236
§ 371 (c)(1),
(2) Date: Jun. 29, 2016

(87) PCT Pub. No.: WO2015/101138
PCT Pub. Date: Jul. 9, 2015

(65) Prior Publication Data

US 2016/0329642 A1 Nov. 10, 2016

(30) Foreign Application Priority Data

Dec. 31, 2013 (CN) ..... 2013 1 0754382

(51) Int. Cl.
*H01Q 9/16* (2006.01)
*H01Q 19/10* (2006.01)
(Continued)

(52) U.S. Cl.
CPC ..... *H01Q 19/10* (2013.01); *H01Q 1/246* (2013.01); *H01Q 1/48* (2013.01); *H01Q 1/521* (2013.01);
(Continued)

(58) Field of Classification Search
CPC ..... H01Q 19/10; H01Q 9/16; H01Q 5/385; H01Q 21/26
(Continued)

(56) References Cited

U.S. PATENT DOCUMENTS 3,922,683 A * 11/1975 Kumpebeck ..... H01Q 5/48 343/797
4,528,568 A * 7/1985 Woloszczuk ..... H01Q 9/26 343/770
(Continued)

FOREIGN PATENT DOCUMENTS

CN 201174424 12/2008
CN 101425626 A 5/2009
(Continued)

OTHER PUBLICATIONS

International Search Report for PCT/CN2014/093236 dated Feb. 17, 2015.

*Primary Examiner* — Hai Tran
(74) *Attorney, Agent, or Firm* — Fay Sharpe LLP

(57) ABSTRACT

The present application provides a multi-band antenna, comprising at least one low-band sub-antenna; and at least one high-band sub-antenna comprising at least one high-band dipole and a reflector; wherein the high-band dipole and/or the reflector are/is structured and positioned so that current induced in the high-band sub-antenna by the low-band sub-antenna is directed to reflector over an extended effective distance in proportion to wavelength of the low-band sub-antenna.

8 Claims, 19 Drawing Sheets

(51) Int. Cl.

| | |
|---|---|
| ***H01Q 21/26*** | (2006.01) |
| ***H01Q 1/24*** | (2006.01) |
| ***H01Q 1/48*** | (2006.01) |
| ***H01Q 1/52*** | (2006.01) |
| ***H01Q 21/28*** | (2006.01) |
| *H01Q 21/24* | (2006.01) |
| *H01Q 5/385* | (2015.01) |

(52) U.S. Cl.
CPC ..... *H01Q 21/26* (2013.01); *H01Q 21/28* (2013.01); *H01Q 5/385* (2015.01); *H01Q 9/16* (2013.01); *H01Q 21/24* (2013.01)

(58) Field of Classification Search
USPC ..... 343/848, 797, 793
See application file for complete search history.

(56) References Cited

U.S. PATENT DOCUMENTS

| | | | | |
|---|---|---|---|---|
| 2010/0164810 | A1* | 7/2010 | Chou ..... | H01Q 9/16 343/700 MS |
| 2010/0231462 | A1 | 9/2010 | Tran | |
| 2010/0309084 | A1 | 12/2010 | Bu et al. | |
| 2013/0187822 | A1 | 7/2013 | Shi et al. | |

FOREIGN PATENT DOCUMENTS

| | | | |
|---|---|---|---|
| CN | 102013560 | A | 4/2011 |
| CN | 102544764 | A | 7/2012 |
| CN | 103036019 | | 4/2013 |
| CN | 103730728 | A | 4/2014 |
| CN | 203774460 | U | 8/2014 |
| JP | 2001-144533 | | 5/2001 |
| KR | 10-0277675 | | 1/2001 |

* cited by examiner

MULTI-BAND ANTENNA

FIELD OF THE INVENTION

The present invention relates to antennas, and in particular, relates to multi-band antennas.

BACKGROUND OF THE INVENTION

Antennas play an important role in communication systems and directly affect communication qualities. As wireless technology continues to thrive, multi-band antennas are used to implement higher speed and various types of services.

A multi-band antenna usually includes an array of sub antennas that are generally categorized as low-band antennas and high-band antennas, which can cooperate at different frequency bands, as illustrated in FIG. 1(*a*).

Due to the structure of multi-band antennas introduced above, coupling effect and parasitic radiation between the low-band antenna(s) and the high-band antenna(s) may greatly impair the performance of multi-band antennas and users' experience. FIG. 1(*b*) shows radiation pattern of a low-band sub-antenna array of a conventional multi-band antenna, which is abnormal due to the inter-band coupling effect and parasitic radiation.

Current solution to solve this problem is to add parasitic patches, shaped walls, bars, or arches to the multi-band antennas.

SUMMARY OF THE INVENTION

Due to increase of sub-antennas in multi-band antennas, more and more above mentioned structures such as parasitic patches, shaped walls, bars, or arches need to be added to multi-band antennas in order to reduce coupling effect and parasitic radiation. However, that would greatly increase manufacture cost of multi-band antennas and space of the multi-band antennas would finally become a limit for further addition of such structures.

One embodiment of the present application provides a multi-band antenna, comprising at least one low-band sub-antenna; and at least one high-band sub-antenna comprising at least one high-band dipole and a reflector; wherein the high-band dipole and/or the reflector are/is structured and positioned so that current induced by the low-band sub-antenna is directed to reflector over an extended distance in proportion to wavelength of the low-band sub-antenna.

Specifically, the high-band dipole is spaced from the reflector, but is connected to the reflector over the extended distance which is in form of a metal line.

Specifically, the high-band dipole is spaced from the reflector by a PCB board on which the metal line is located.

Specifically, the metal line is spiral-shaped, and the metal line is positioned directly under the high-band dipole or beside the high-band dipole.

Specifically, the metal line is spiral-shaped and is located on an insulated portion of the high-band dipole, wherein one end of the metal line is connected to a conductive portion of the high-band dipole and another end of the metal line is connected to reflector.

Specifically, the extended distance is formed by a spiral-shaped slot punched in the reflector around the high-band dipole.

Specifically, a metal box is located beneath the reflector configured to cover the spiral-shaped slot to improve front to back ratio of the high-band dipole.

Specifically, the extended distance is in form of at least a cable and a metal box located beneath the reflector through which foot of the high-band dipole is connected to reflector.

Specifically, the extended distance is in proportion to one fourth or one eighth of the wavelength of the low-band sub-antenna.

By extending the effective distance proportionally to the frequency of a low-band sub-antenna for induction current, induced by the low-band sub-antenna in the high-band sub-antenna, to flow from the high-band sub-antenna dipole to the reflector, the coupling effect and parasitic radiation between the sub-antennas are reduced. Extending the effective distance for the induction current means extending connection between the high-band sub-antenna and the reflector, or having the same effect as such extension.

BRIEF DESCRIPTION OF THE DRAWINGS

The above and other objects and features of the present invention will become more apparent from the following detailed description considered in connection with the accompanying drawings, in which:

FIG. 1(*b*) shows radiation pattern of a low-band sub-antenna array of a conventional multi-band antenna;

FIG. 11(*b*) shows a high-band sub-antenna with the structures illustrated in FIG. 11(*a*) and FIGS. 2(*a*)-(*b*);

DETAILED DESCRIPTION OF EMBODIMENTS

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the invention encompass these and other modifications and variations as come within the scope and spirit of the invention.

Figure 2A:
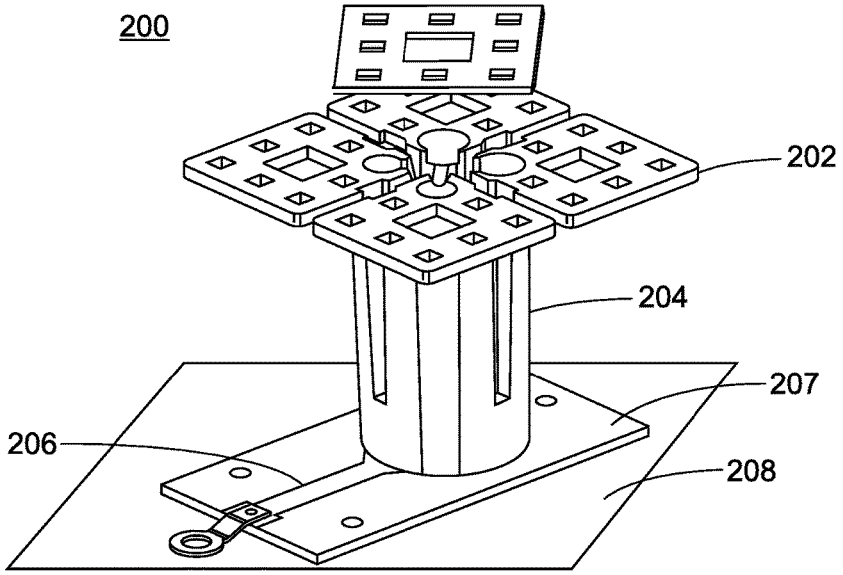
FIGS. 2(*a*) and(*b*) show a high-band sub-antenna in accordance with one embodiment of the present application.
Figure 2B:
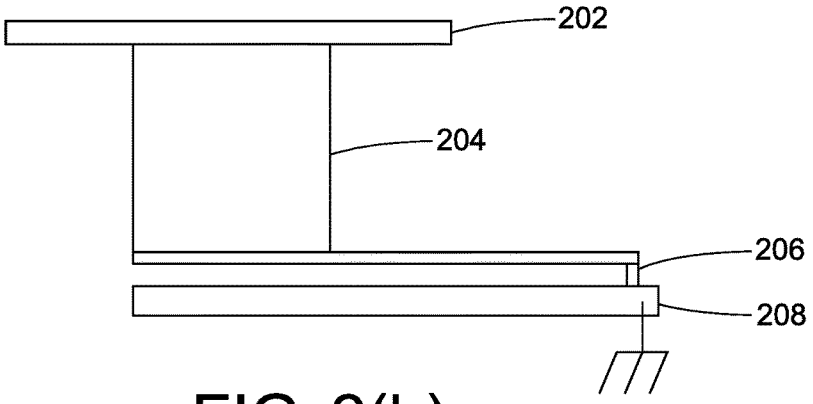

FIG. 2(*a*) is a 3-D illustration and FIG. 2(*b*) is schematic drawing of a high-band sub-antenna 200 of a multi-band in accordance with one embodiment of the present application. As illustrated in FIGS. 2(*a*) and(*b*), high-band sub-antenna 200 may include dipole arms 202, a support portion 204, and a reflector 208, wherein the support portion 204 is not connected to reflector 208 directly. Support portion 204 is separated from reflector 208 by a PCB board and is coupled to reflector 208 via a metal line 206 extending on the PCB board. Length of metal line 206 may be in proportion to a low-band sub antenna that is to cooperate with high-band sub-antenna 200.

Figure 3:
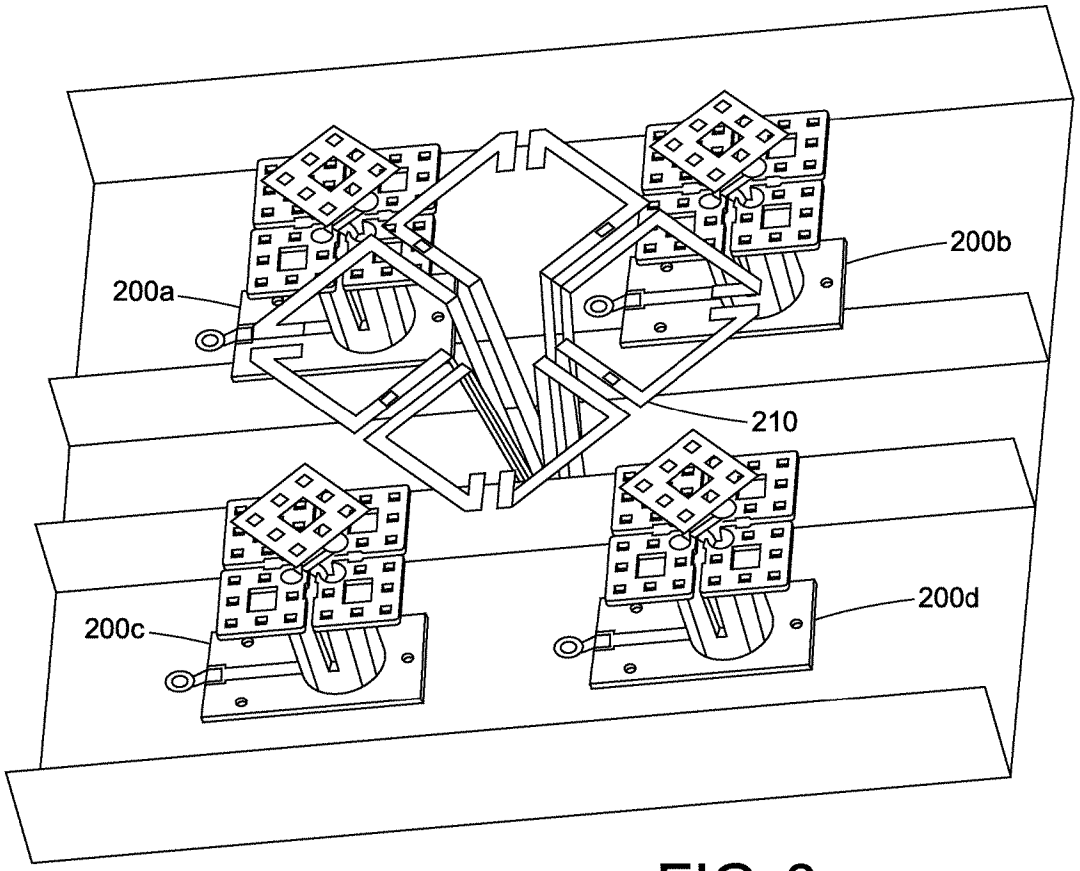
FIG. 3 is a top view of a multi-band antenna with four high-band sub-antennas illustrated in FIG. 2.

FIG. 3 is a top view of a multi-band antenna including high-band sub-antenna as illustrated in FIG. 2 in accordance to one embodiment of the present application. In FIG. 3, multi-band antenna may include four high-band sub-antennas 200*a-d*, each of which may have the same structure as high-band sub-antenna 200 in FIG. 2. In particular, each of high-band sub-antennas 200*a-d* may be connected to the reflector via a metal line extending on a PCB board.

In the center of the four high-band antennas 200*a-d*, stands a low-band sub-antenna 210, which may have a frequency F. Length of each of the metal lines respectively coupling high-band sub-antenna 200*a-d* to the reflector may be proportional to F, for example ¼ or ⅛ of F.

Figure 1A:
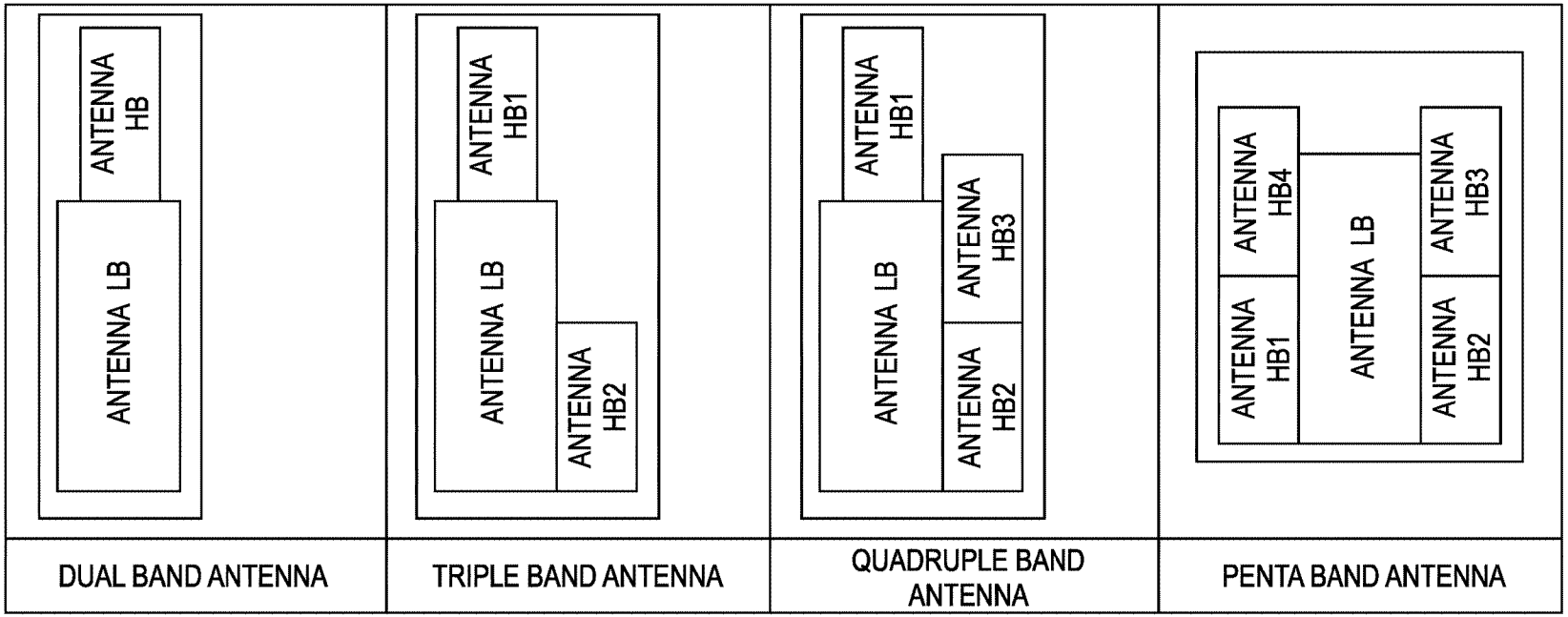
FIG. 1(*a*) shows block diagrams of a plurality of multi-band antennas.
Figure 1B:
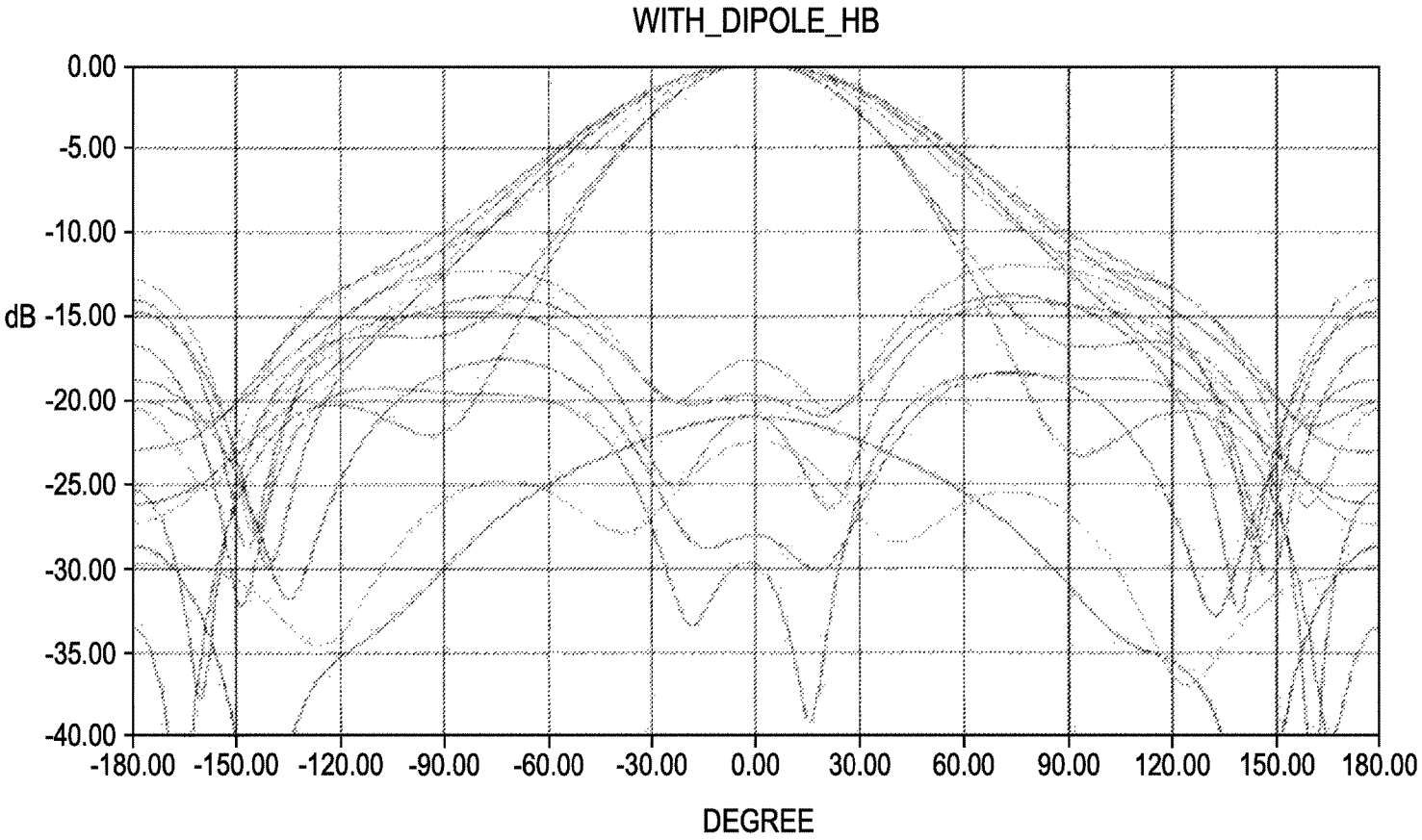
Figure 4:
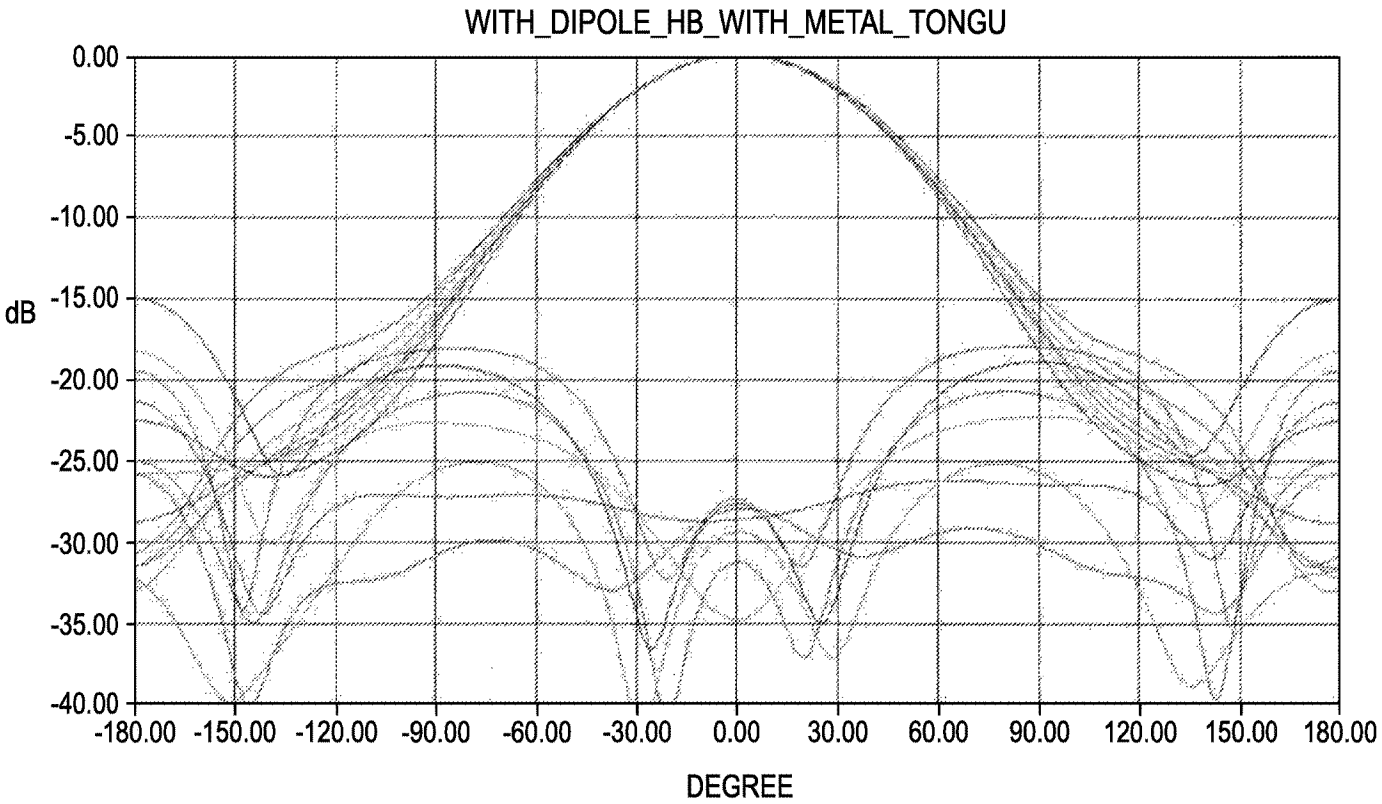
FIG. 4 is a radiation pattern of the low-band sub-antenna array cooperating with high-band sub-antenna array including high-band sub-antennas as illustrated in FIG. 2.

FIG. 4 shows a radiation pattern of the low-band sub-antenna array of the multi-band antenna illustrated in FIG. 3. Compared to FIG. 1(*b*), the pattern becomes much more normal, regarding the respective of linear beam-width and normal cross-polarization discrimination (XPD).

Figure 5B:
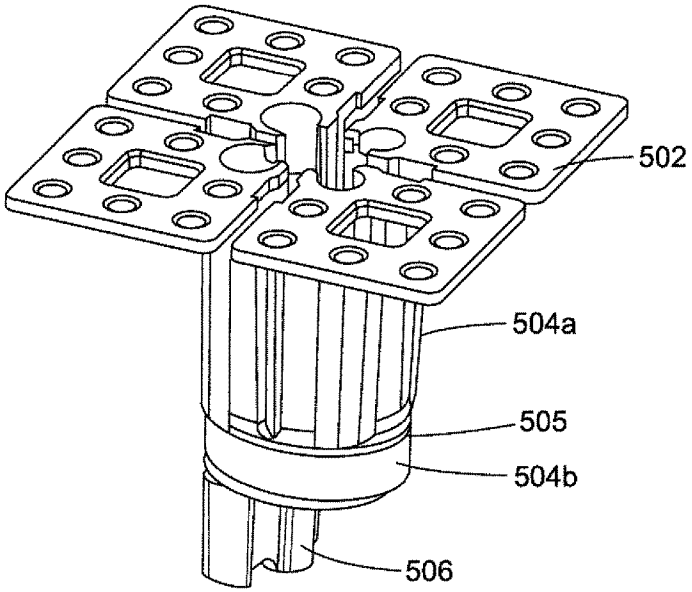
FIGS. 5(*a*)-(*b*) show a high-band dipole in accordance with another embodiment of the present application.
Figure 5A:
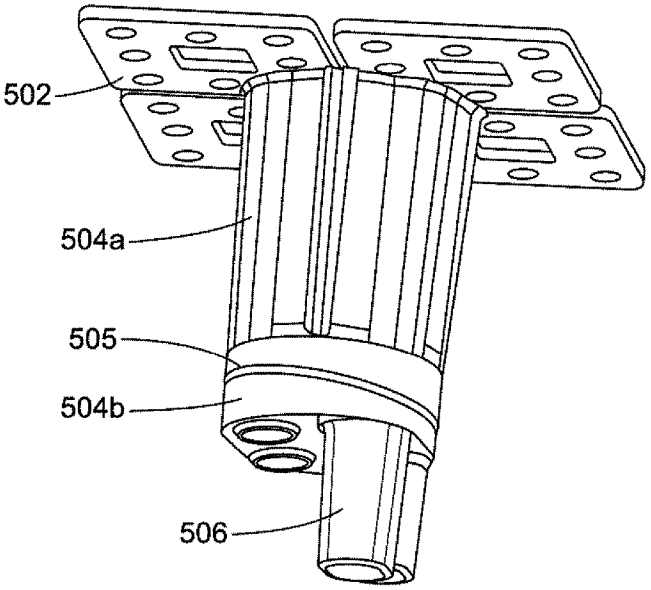

FIG. 5 shows a high-band dipole of another multi-band antenna in accordance with another embodiment of the present application. High-band dipole may include dipole arms 502, a support portion 504*a* made of conducting materials such as metal, and support portion 504*b* made of insulating materials such as plastic. Foot 506 of the high-band dipole may be made of conducting materials as well. A conductive line 505 may be spirally around or embedded in support portion 504*b* and configured to couple support portion 504*a* to dipole foot 506 and further to the reflector.

Figure 6:
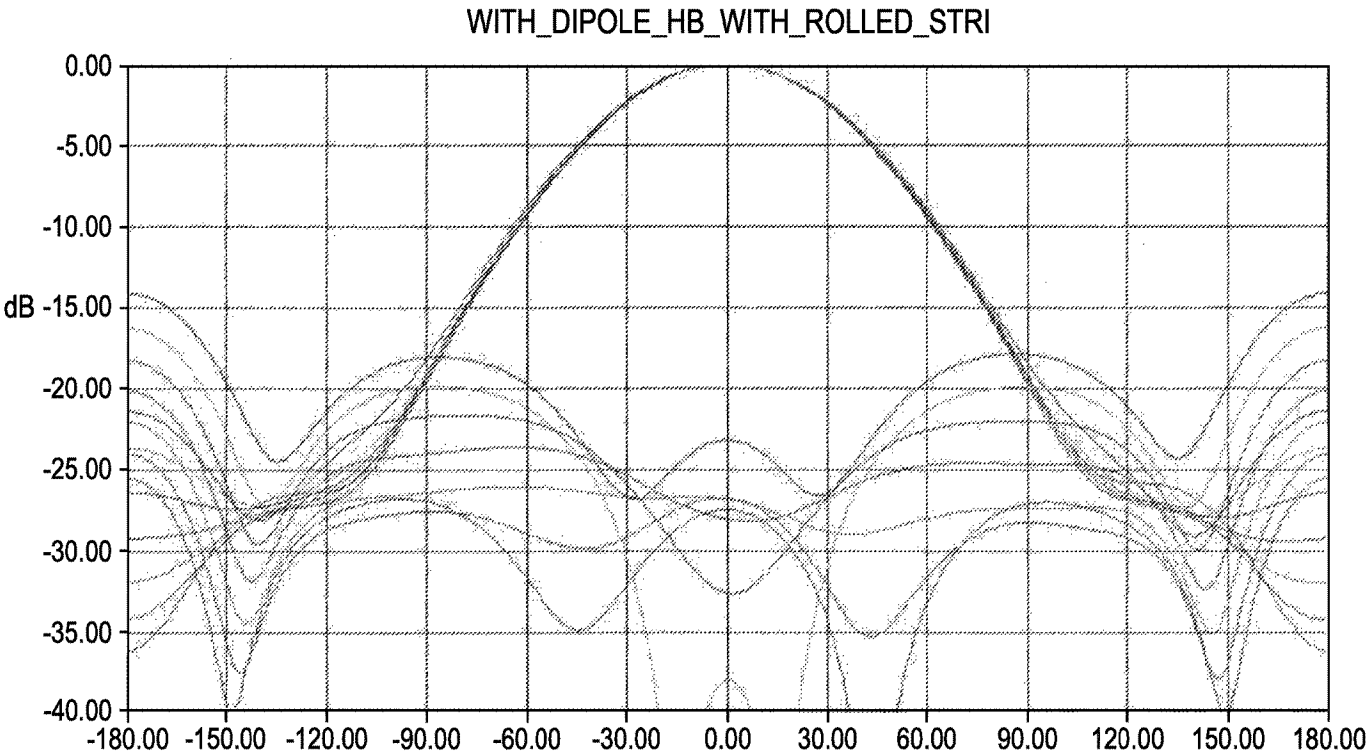
FIG. 6 is a radiation pattern of the low-band sub-antenna array cooperating with high-band sub-antenna array including high-band dipoles as illustrated in FIG. 5.
Figure 7B:
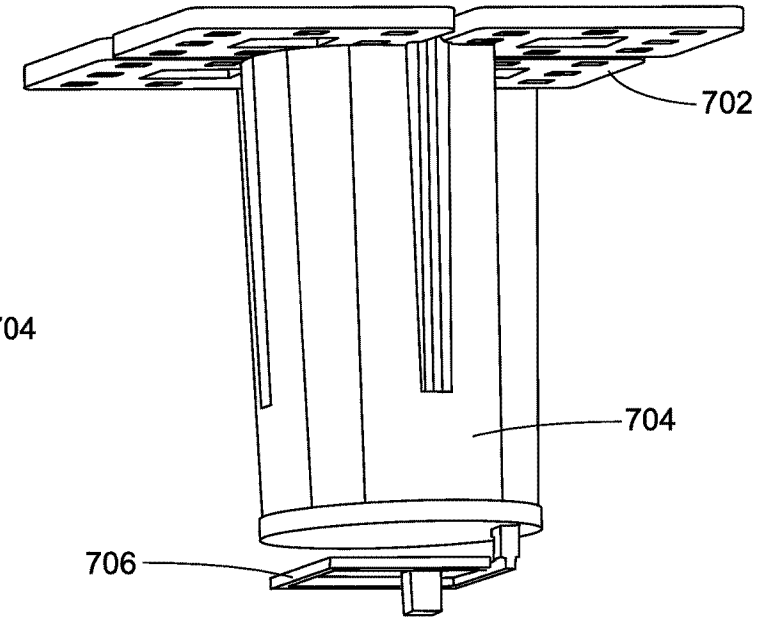
FIGS. 7(*a*)-(*d*) show a high-band dipole in accordance with another embodiment of the present application.
Figure 7A:
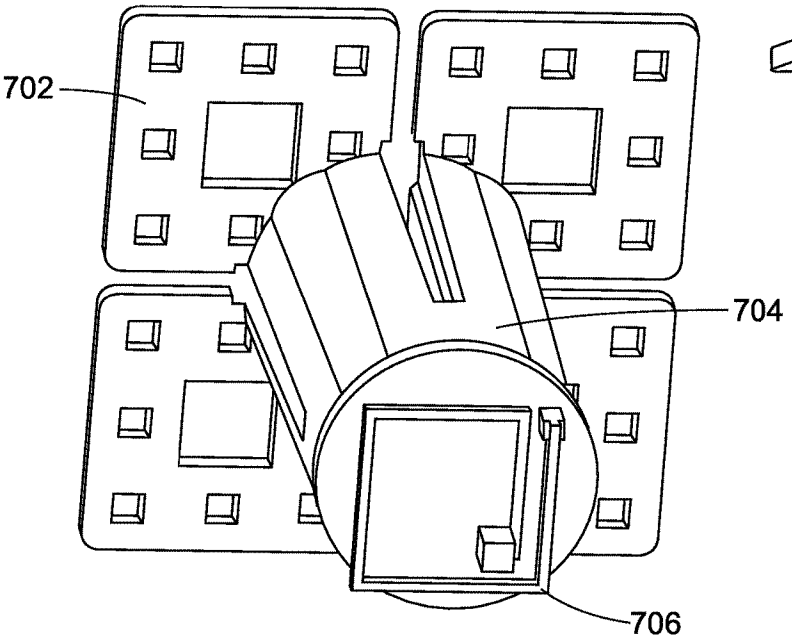
Figure 7D:
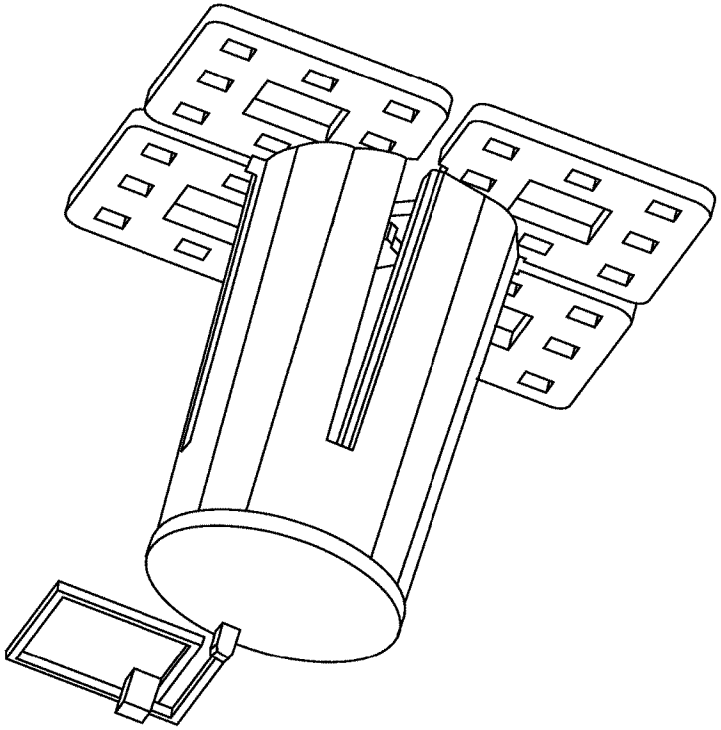
Figure 7C:
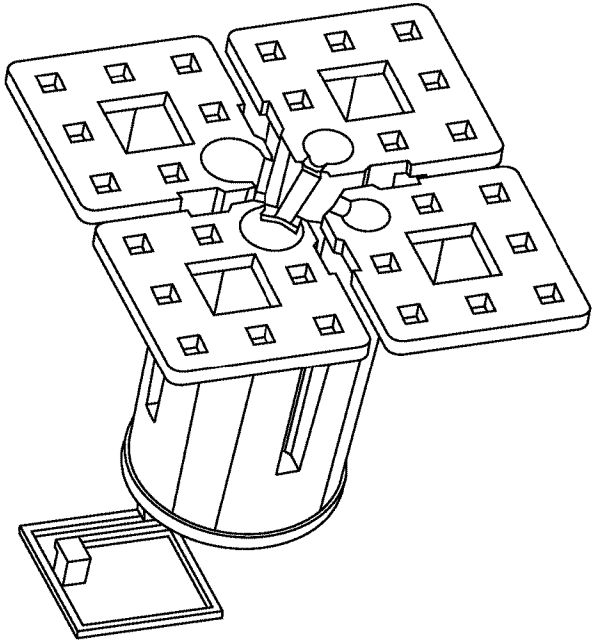

FIG. 6 shows a radiation pattern of the low-band sub-antenna array of the multi-band antenna which includes high-band dipole as illustrated in FIG. 5. Compared to FIG. 1(*b*), the pattern also is much more normal, regarding the respective of linear beam-width and normal cross-polarization discrimination (XPD).

FIG. 7 shows a high-band dipole of a multi-band antenna in accordance with one embodiment of the present application. High-band dipole may include dipole arms 702, a support portion 704 and an extension portion 706, each of which may be made of conducting materials. Support portion 704 may be not in direct connection with the reflector but is coupled to the reflector via extension portion 706. In particular, extension portion 706 may be a spirally shaped metal bracket with one end contacting support portion 704 and the other end contacting the reflector. Length of extension portion 706 may be in proportion to frequency of a low-band sub-antenna that is to be used cooperating with high-band dipole to form the multi-band antenna.

FIGS. 7(*a*) and(*b*) show an example of extension portion 706 positioned right under support portion 704. FIGS. 7(*c*) and(*d*) show an example of extension portion 706 positioned beside support portion 704. People of ordinary skills in art would know that any position of extension portion 706 in relative to support portion 704 would be within the scope of the present application.

Figure 8A:
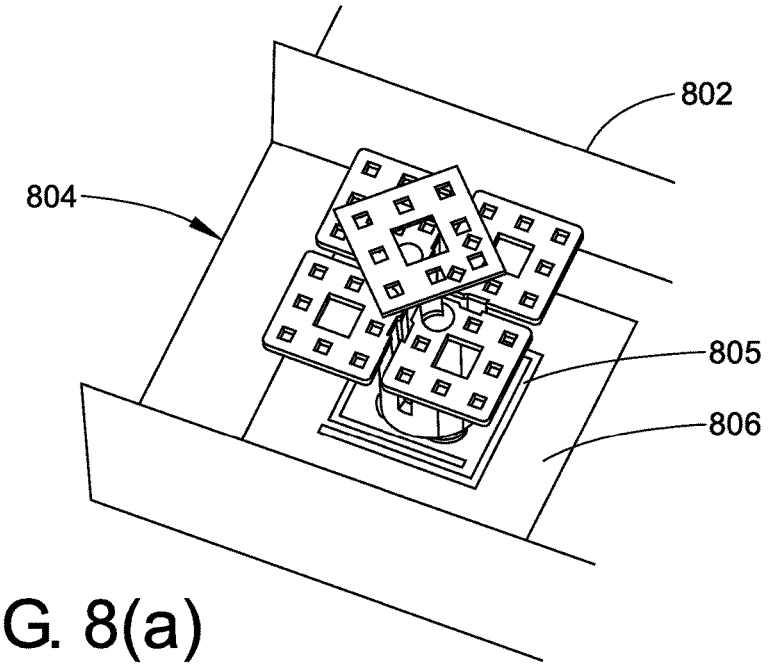
FIGS. 8(*a*)-(*b*) show a high-band dipole in accordance with another embodiment of the present application.
Figure 8B:
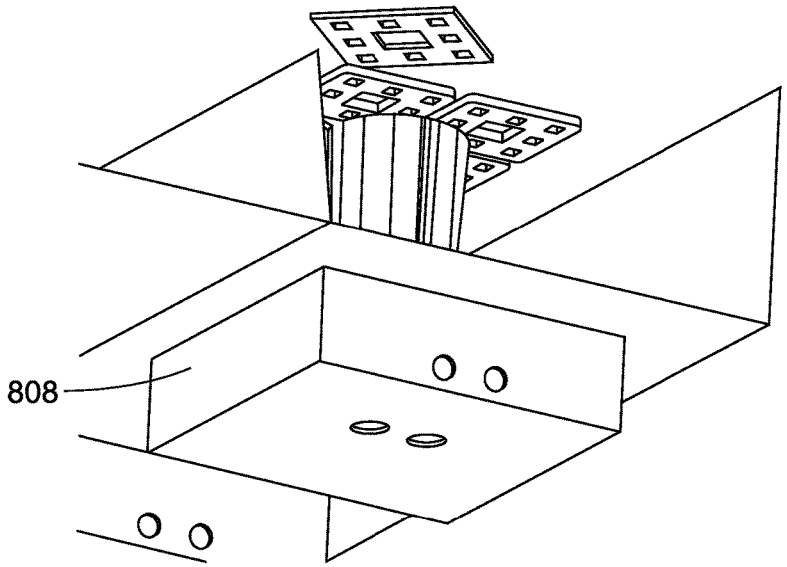

FIGS. 8(*a*) and(*b*) show a high-band sub-antenna of a multi-band antenna in accordance with a further embodiment of the present application. High-band sub-antenna may include dipole arms 802, a support portion 804 and a reflector 806. In particular, a spiral shaped slot 805 is carved in the reflector 806 around support portion 804. Slot 805 brings the same effect as current inducted in high-band sub-antenna by a low-band sub-antenna is directed to the reflector 806 via an extended distance that is proportional to the wavelength of the low-band sub-antenna.

In order to improve the front to back ratio of high-band sub-antenna, a box/block 808 may be added beneath reflector 806 and to cover slot 805.

Figure 9A:
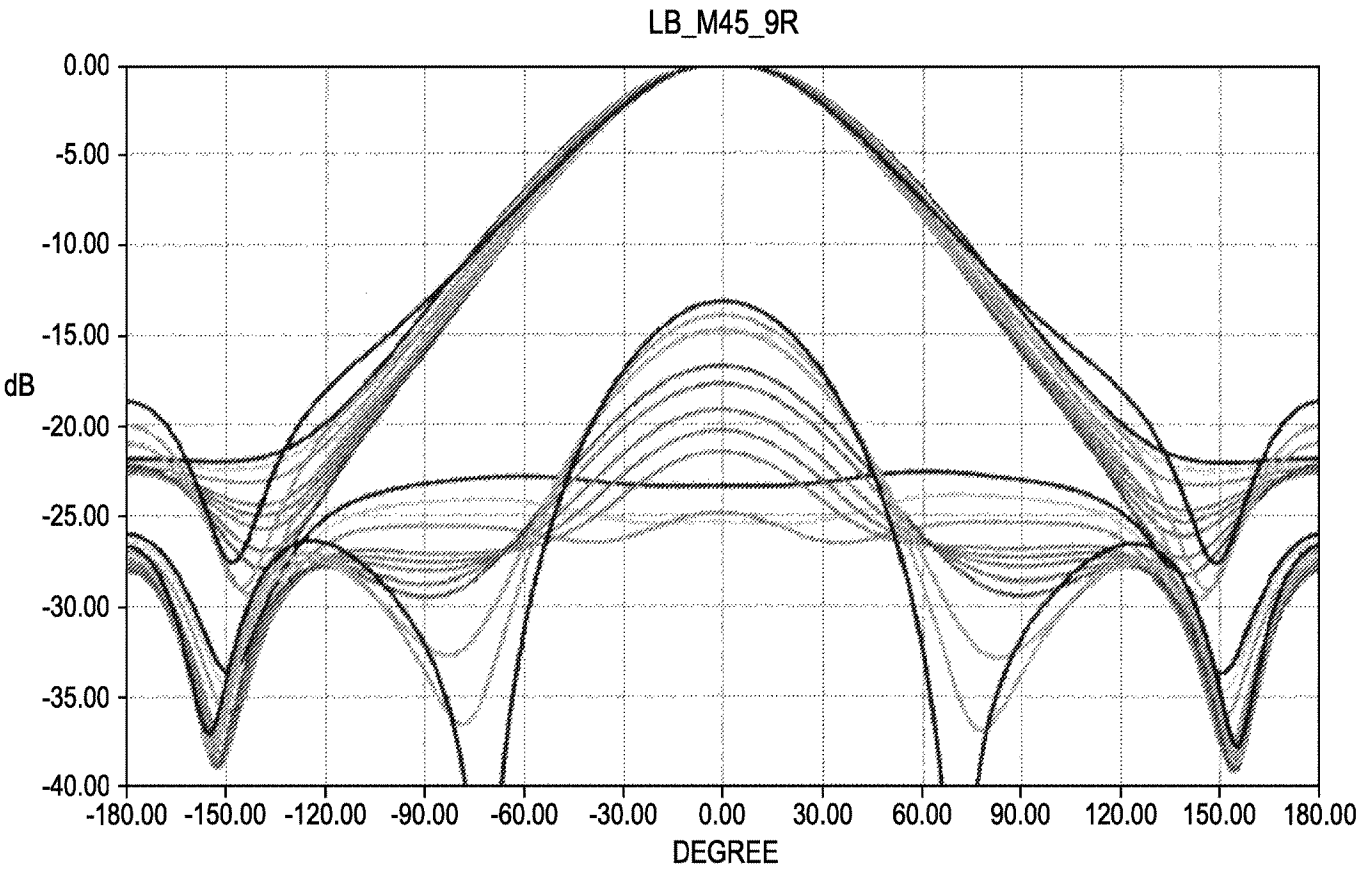
FIGS. 9(*a*)-(*b*) are radiation pattern of a low-band sub-antenna array cooperating with high-band sub-antenna array including high-band dipoles as illustrated in FIG. 8.
Figure 9B:
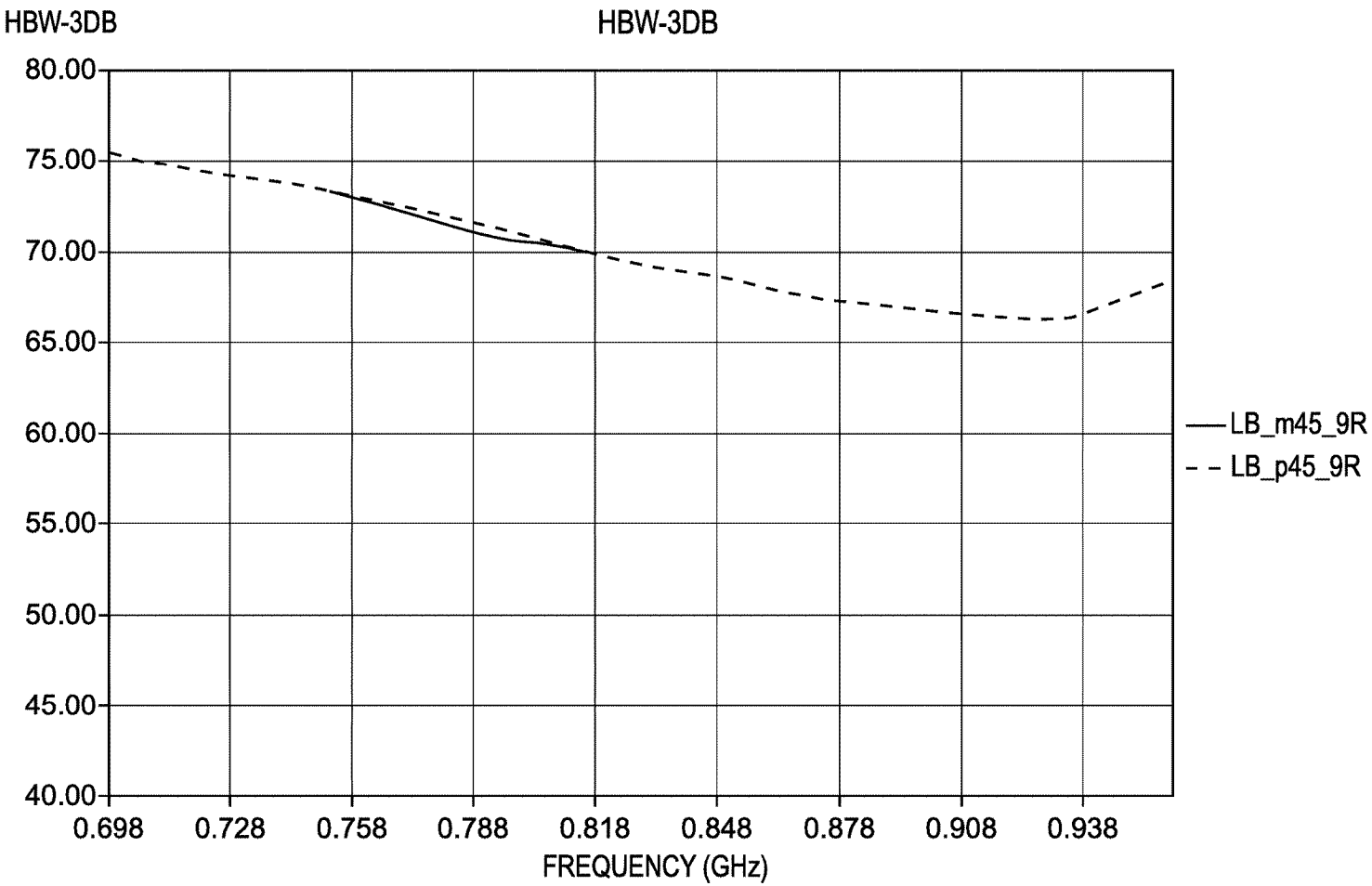

FIG. 9(*a*) shows a radiation pattern of the low-band sub-antenna array of a multi-band antenna which includes high-band sub-antennas as illustrated in FIG. 8. FIG. 9(*b*) is the curve of beam-width in FIG. 9(*a*), which shows that the beam-width is almost linear and therefore can meet the need of communication well.

Figure 10A:
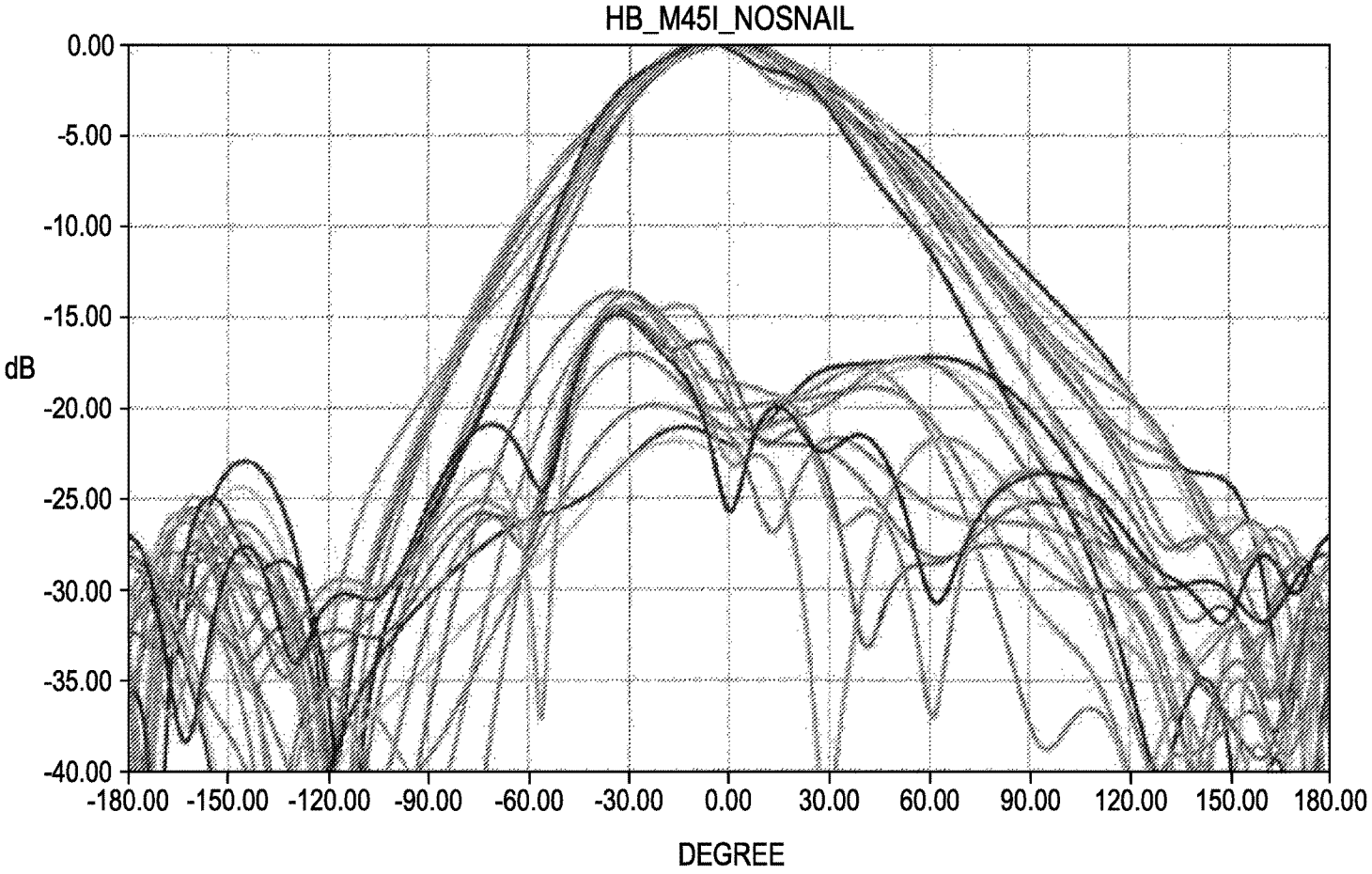
FIGS. 10(*a*)-(*b*) are radiation pattern of a high-band sub-antenna array with and without the structure illustrated in FIG. 8.
Figure 10B:
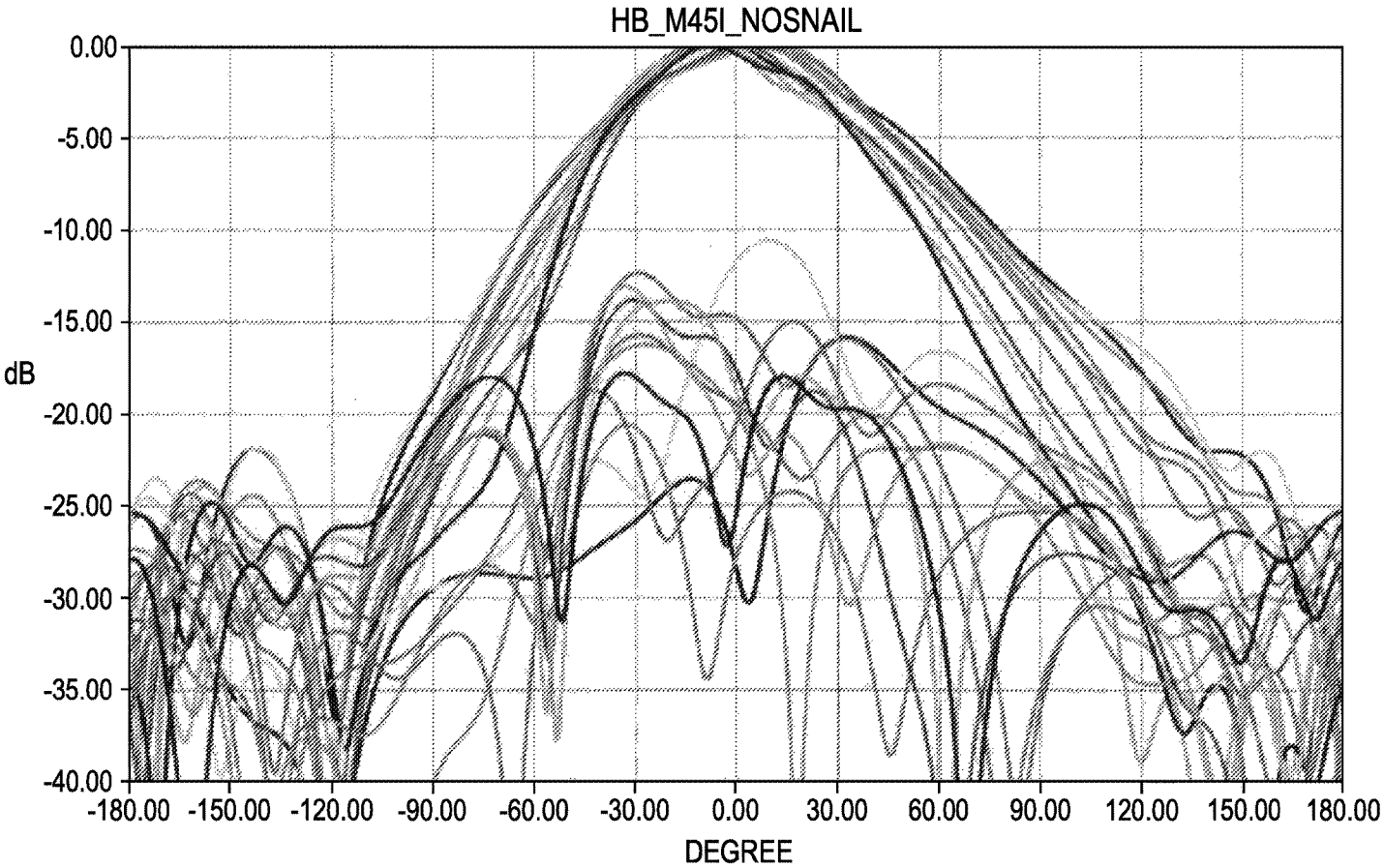

FIG. 10(*a*) is a radiation pattern of high-band sub-antenna array without the slot structure shown in FIG. 8. FIG. 10(*b*) is a radiation pattern of high-band sub-antenna array with the slot structure shown in FIG. 8, which shows that the front to back ratio is not deteriorated due to the addition of the metal box/block 808. Patterns in FIGS. 10(*a*) and(*b*) are similar which means low band performance is greatly improved because of the slot and box/block structures.

Figure 11A:
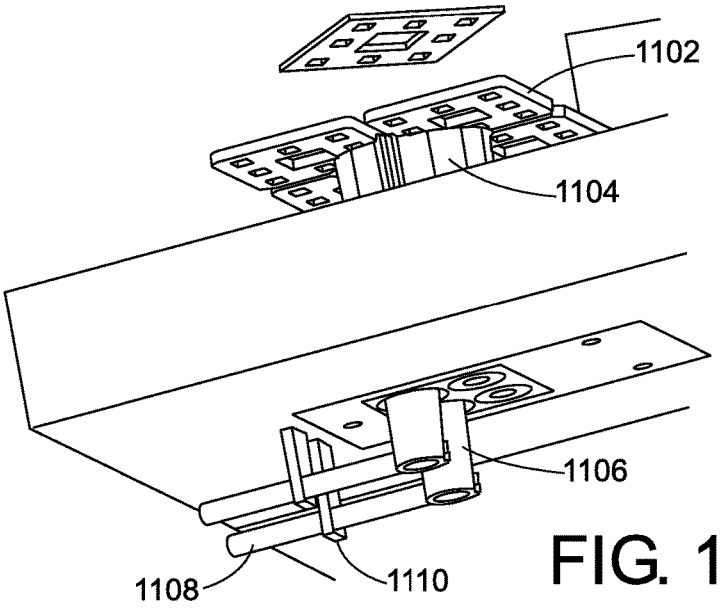
FIG. 11(*a*) shows a high-band sub-antenna in accordance with another embodiment of the present application.
Figure 11B:
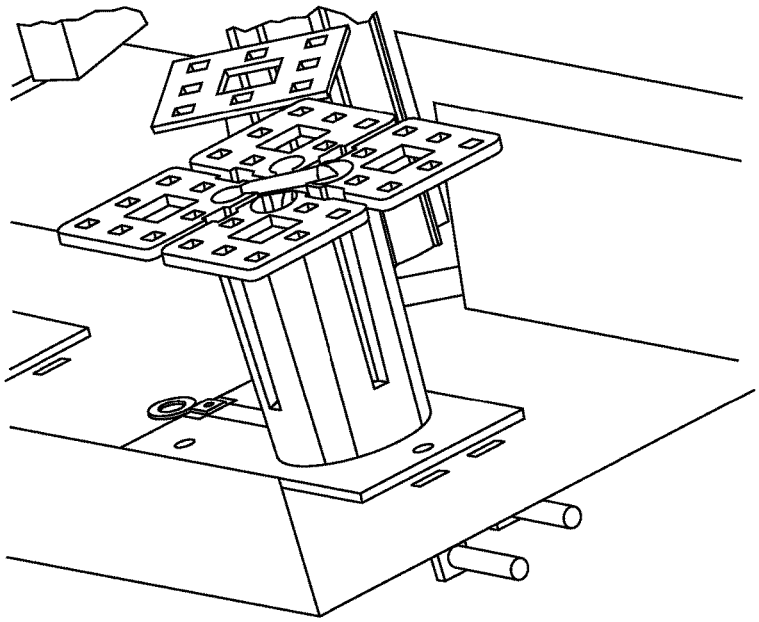

FIG. 11(*a*) shows a high-band sub-antenna of a multi-band antenna in accordance with one embodiment of the present application. High-band sub-antenna may have dipole arms 1102, a support portion 1104, dipole feet 1106, cables 1108 connecting dipole feet 1106 to a reflector, and a metal box 1110 positioned beneath the reflector and is passed through by cables 1108. In particular, support portion 1104 and dipole feet 1106 are made of conducting materials but are not in direct contact with the reflector.

In one embodiment, length of cables 1106 and size of metal box 1110 are designed to have current induced in high-band sub-antenna by a low-band sub-antenna directed to the reflector via an extended distance that is proportional to wavelength of the low-band sub-antenna.

FIG. 11(*b*) shows a high-band sub-antenna with the metal line structure illustrated in FIGS. 2(*a*)-(*b*) and the cable and metal box/block structure illustrated in FIG. 11(*a*).

Figure 12A:
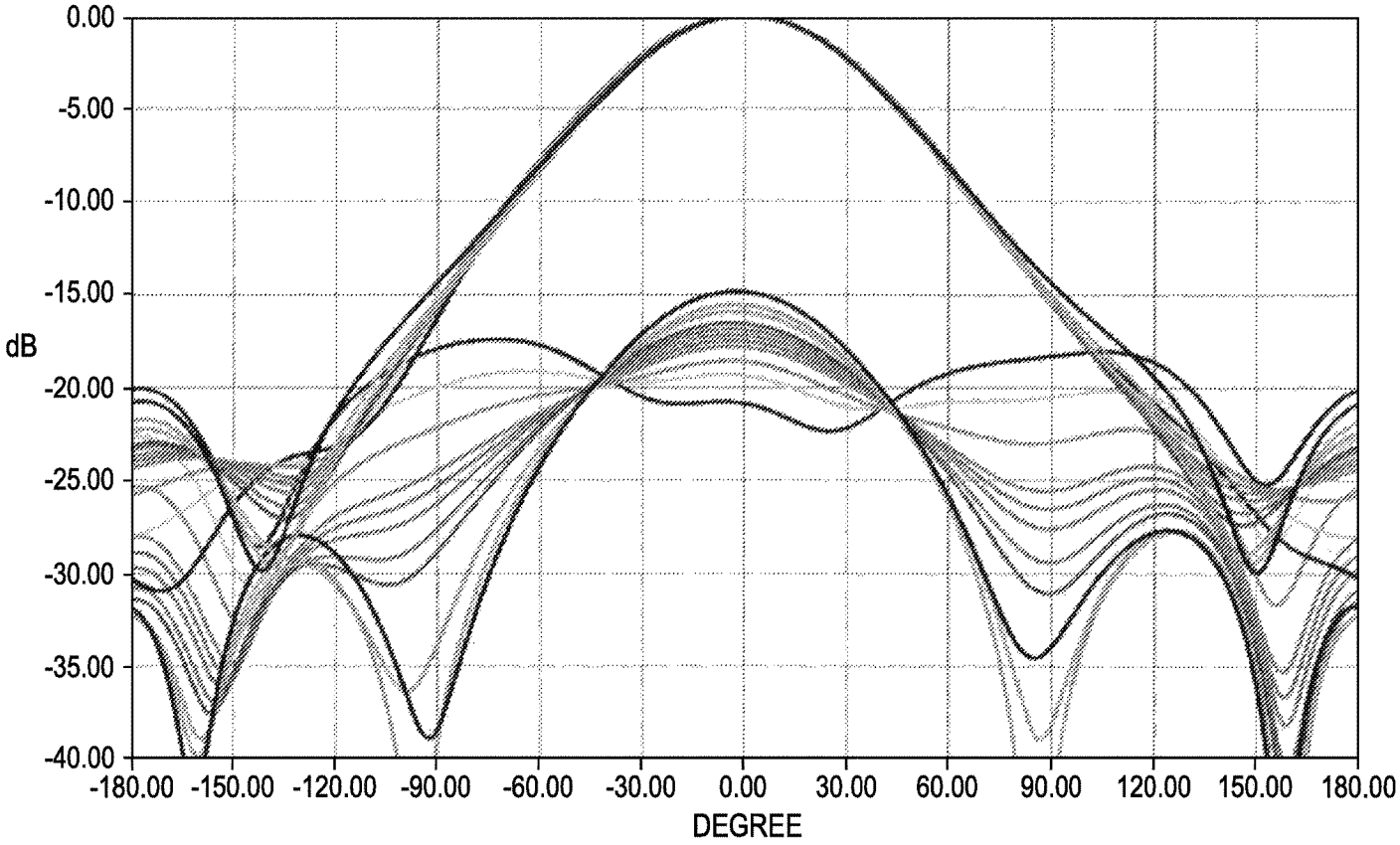
FIGS. 12(*a*) and(*b*) are radiation pattern of a low-band sub-antenna array cooperating with high-band sub-antenna array including high-band sub-antennas as illustrated in FIG. 11(*a*)
Figure 12B:
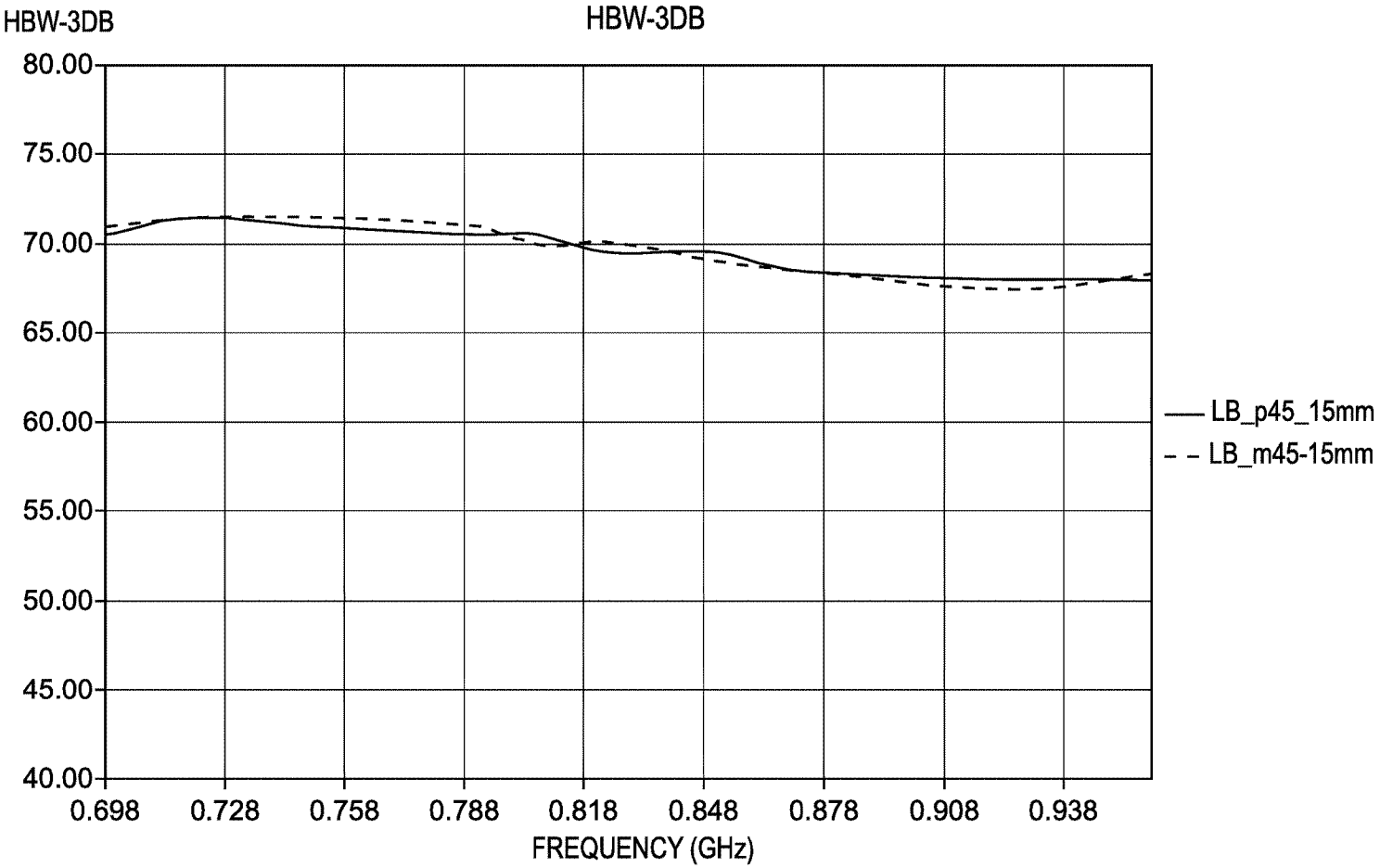

FIG. 12(*a*) shows radiation pattern of a low-band sub-antenna array of a multi-band antenna including high-band sub-antennas as illustrated in FIG. 11(*a*). Compared to FIG. 1(*b*), the pattern also is much more normal. FIG. 12(*b*) is the curve of beam-width in FIG. 12(*a*), which shows that the beam-width is almost linear and therefore can meet the need of communication.

Figure 13A:
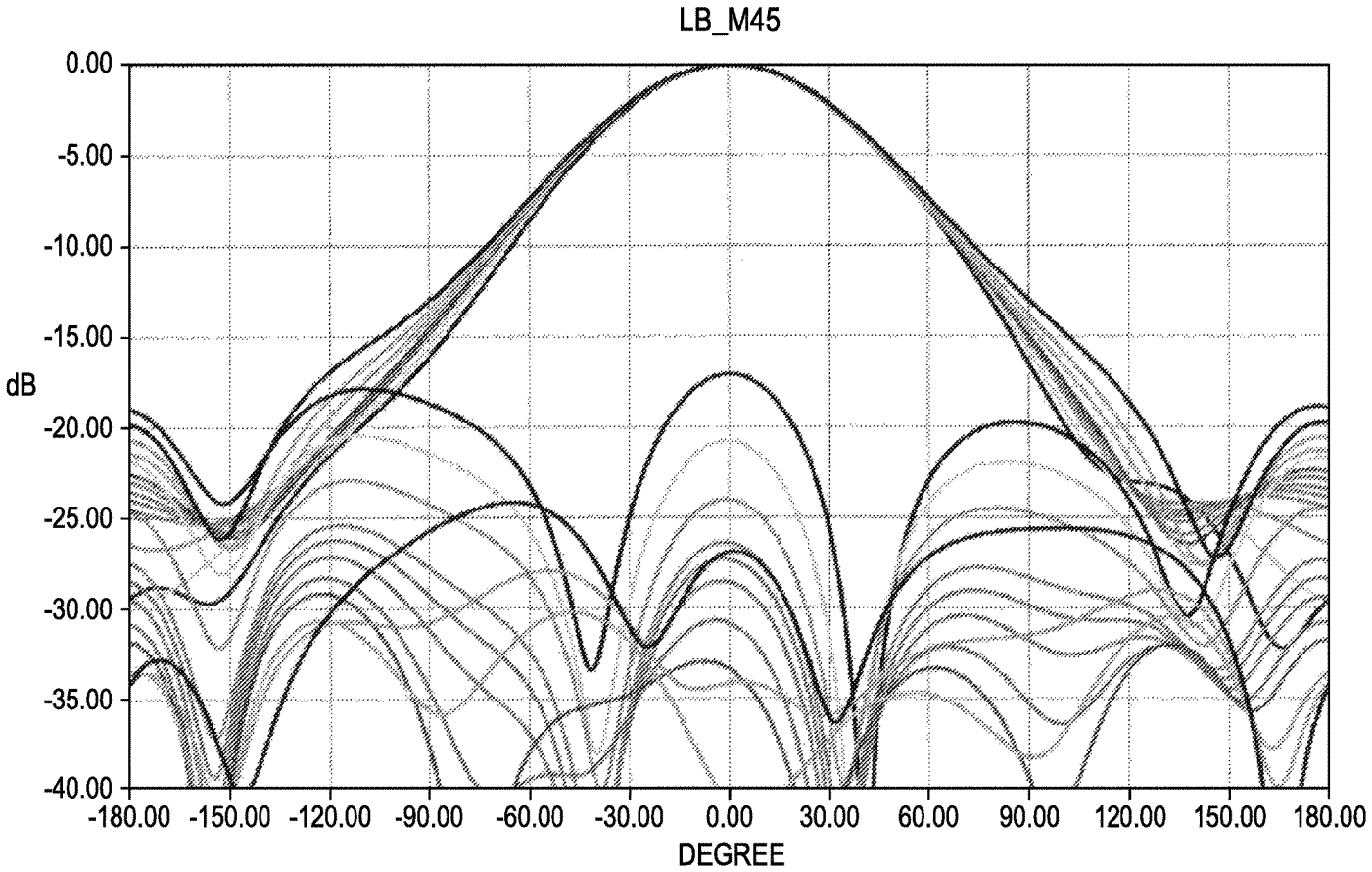
FIGS. 13(*a*) and(*b*) are radiation pattern of a low-band sub-antenna array cooperating with high-band sub-antenna array including high-band sub-antennas as illustrated in FIG. 11(*b*).
Figure 13B:
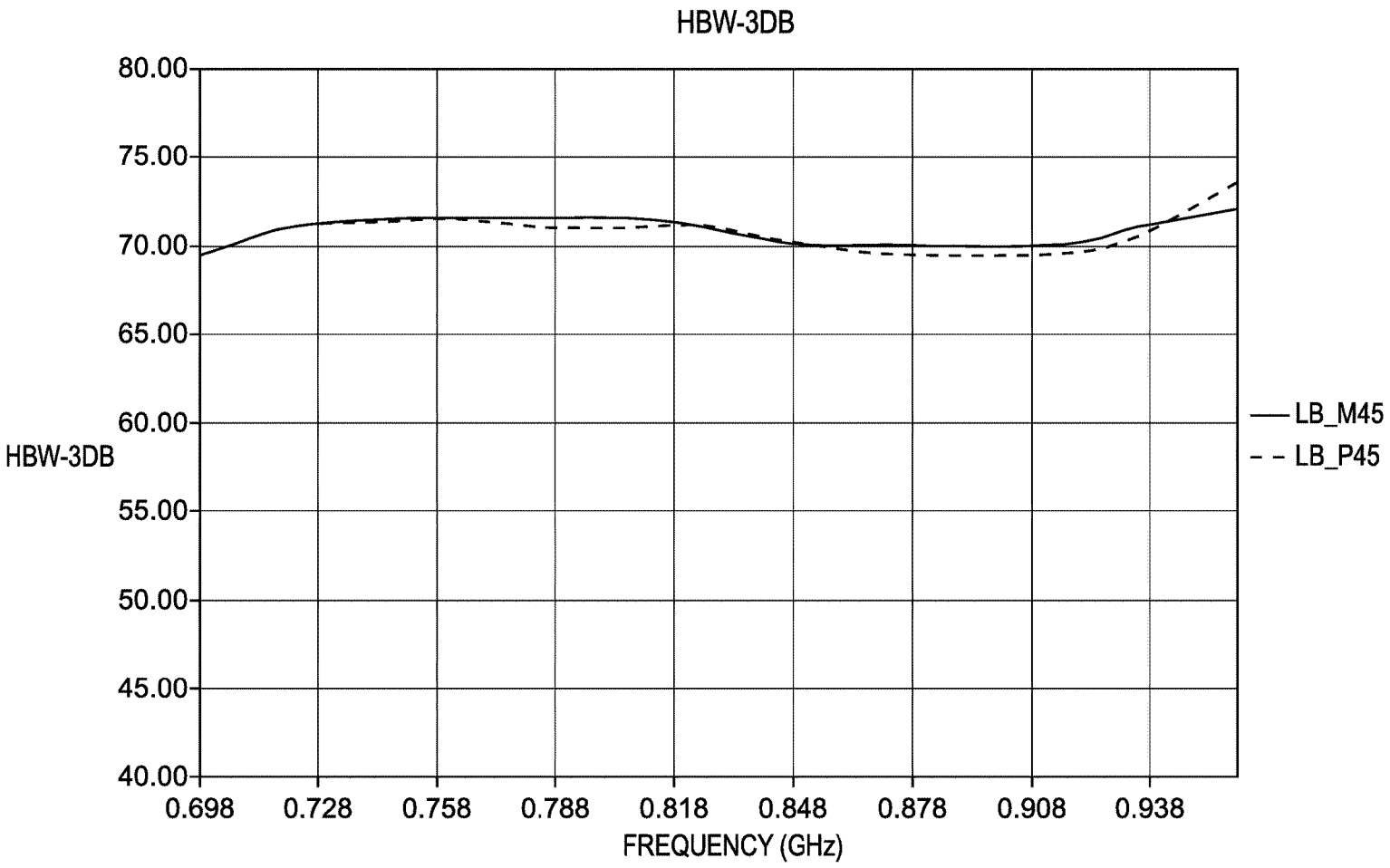

FIG. 13(*a*) shows radiation pattern of a low-band sub-antenna array of a multi-band antenna including high-band sub-antennas as illustrated in FIG. 11(*b*). Compared to FIG. 1(*b*), the pattern also is much more normal. FIG. 13(*b*) is the curve of beam-width in FIG. 13(*a*), which shows that the beam-width is almost linear and therefore can meet the need of communication.

In the present application, the reflectors described are directed to ground. Length/size of the extended distance, such as the metal line and the various structures for extending the effective distance, may be proportional to ¼ or ⅛ of the frequency of the low-band sub-antenna cooperating with the high-band sub-antenna.

It should be noted that the above described embodiments are given for describing rather than limiting the invention, and it is to be understood that modifications and variations may be resorted to without departing from the spirit and scope of the invention as those skilled in the art readily understand. Such modifications and variations are considered to be within the scope of the invention and the appended claims. The protection scope of the invention is defined by the accompanying claims. In addition, any of the reference numerals in the claims should not be interpreted as a limitation to the claims. Use of the verb "comprise" and its conjugations does not exclude the presence of elements or steps other than those stated in a claim. The indefinite article "a" or "an" preceding an element or step does not exclude the presence of a plurality of such elements or steps.

What is claimed is:

1. A multi-band antenna, comprising at least one low-band sub-antenna; and at least one high-band sub-antenna comprising at least one high-band dipole, a support portion, a metal line and a reflector; wherein the high-band dipole is spaced from the reflector;

the metal line is configured to couple the support portion with the reflector;

the low-band sub-antenna is configured to induce current in the high-band sub-antenna, the current flowing toward the reflector through the metal line; and the metal line is configured to extend an effective distance of the current flowing between the high band dipole and the reflector by a distance in proportion to a wavelength of the low-band sub-antenna.

2. The multi-band antenna of claim 1, wherein the high-band dipole is spaced from the reflector by a PCB board on which the metal line is located.

3. The multi-band antenna of claim 1, wherein the high-band dipole is spaced from the reflector, the high-band sub-antenna further comprises a metal bracket which is spiral-shaped and configured to couple the high-band dipole to the reflector, and the metal bracket is positioned under the high-band dipole or beside the high-band dipole.

4. The multi-band antenna of claim 1, wherein the metal line is spiral-shaped and is located or embedded on an insulated portion of the high-band dipole, wherein one end of the metal line is connected to a conductive portion of the high-band dipole and another end of the metal line is connected to the reflector.

5. The multi-band antenna of claim 1, wherein a spiral-shaped slot is punched in the reflector around the high-band dipole.

6. The multi-band antenna of claim 5, wherein the high-band sub-antenna further includes a metal box located beneath the reflector configured to cover the spiral-shaped slot to improve front to back ratio of the high-band sub-antenna.

7. The multi-band antenna of claim 1, wherein the extended distance is in form of at least a cable and a metal box/block located beneath the reflector through which the high-band dipole is coupled to reflector.

8. The multi-band antenna of claim 1, wherein the extended distance is in proportion to one fourth or one eighth of the wavelength of the low-band sub-antenna.

* * * * *